US008585021B2

(12) United States Patent
Elliott et al.

(10) Patent No.: US 8,585,021 B2
(45) Date of Patent: Nov. 19, 2013

(54) SLACK ROPE AND LIFT CONTROL FOR USE WITH PLOW

(75) Inventors: Ronald L. Elliott, Oregon City, OR (US); Paul DeKoning, Portland, OR (US); Jim Thorne, Portland, OR (US); Joshua K. Hoyt, Portland, OR (US)

(73) Assignee: Warn Industries, Inc., Clackamas, OR (US)

( * ) Notice: Subject to any disclaimer, the term of this patent is extended or adjusted under 35 U.S.C. 154(b) by 401 days.

(21) Appl. No.: 12/961,060

(22) Filed: Dec. 6, 2010

(65) Prior Publication Data

US 2012/0138881 A1 Jun. 7, 2012

(51) Int. Cl.
*B66D 1/00* (2006.01)

(52) U.S. Cl.
USPC ..... 254/323; 254/268

(58) Field of Classification Search
USPC ..... 180/210; 254/323, 328, 268, 273, 275, 254/276, 277; 280/727, 760, 764.1; 37/231, 37/235, 271, 266, 279
See application file for complete search history.

(56) References Cited

U.S. PATENT DOCUMENTS

| | | | | |
|---|---|---|---|---|
| 819,195 | A | 5/1906 | Wright | |
| 850,694 | A | 4/1907 | Valentine | |
| 888,157 | A | 5/1908 | Giovannoni | |
| 1,113,337 | A | 10/1914 | Hart | |
| 2,842,039 | A | 7/1958 | Swingle | |
| 2,912,632 | A | 11/1959 | Turtil | |
| 2,991,403 | A | 7/1961 | Groft | |
| 3,960,362 | A | 6/1976 | Griffiths et al. | |
| 4,305,513 | A * | 12/1981 | Voelz | 212/276 |
| 4,403,432 | A | 9/1983 | Biance | |
| 4,484,647 | A | 11/1984 | McGrew | |
| 4,491,301 | A * | 1/1985 | Pendola | 254/285 |
| 4,821,436 | A * | 4/1989 | Slocum | 37/235 |
| 6,135,421 | A | 10/2000 | Bartelme et al. | |
| 6,334,269 | B1 * | 1/2002 | Dilks | 37/235 |
| 6,393,737 | B2 | 5/2002 | Quenzi et al. | |
| 6,843,002 | B1 | 1/2005 | Moffitt | |
| 6,964,121 | B2 | 11/2005 | Harris | |
| 7,219,453 | B2 * | 5/2007 | Baker | 37/232 |
| 7,284,743 | B1 | 10/2007 | Brighton et al. | |
| 7,302,765 | B1 | 12/2007 | Jorgenson et al. | |
| 7,419,011 | B2 | 9/2008 | Curtis et al. | |
| 7,661,210 | B2 * | 2/2010 | Shepherd | 37/232 |

(Continued)

FOREIGN PATENT DOCUMENTS

WO 2004063079 A2 7/2004

*Primary Examiner* — Emmanuel M Marcelo
*Assistant Examiner* — Justin Stefanon
(74) *Attorney, Agent, or Firm* — Harness, Dickey & Pierce, P.L.C.

(57) ABSTRACT

A system for controlling slack in a winch rope associated with a vehicle can include a winch, a plow, and a support member pivotably coupled to the plow and carrying a pulley that receives the rope for raising and lowering the plow. A limit switch can be operatively associated with the winch and configured to selectively enable and disable lowering of the plow by the winch. A first member can be carried by the support member and operatively associated with the switch. A biasing member can bias the support member to a first position when a load on the winch rope is below a predetermined threshold. The first member can be in at least substantial alignment with the switch when in the first position. The switch can change an activation state upon the first member being in the first position to automatically disable lowering of the plow by the winch.

30 Claims, 9 Drawing Sheets

(56) References Cited

U.S. PATENT DOCUMENTS

| | | | | |
|---|---|---|---|---|
| 7,686,095 | B2 | 3/2010 | Batthala et al. | |
| 8,019,515 | B2 | 9/2011 | Okeson et al. | |
| 2003/0127635 | A1* | 7/2003 | Morse et al. | 254/268 |
| 2004/0183526 | A1* | 9/2004 | Galbreath et al. | 324/207.2 |
| 2006/0005433 | A1 | 1/2006 | Curtis et al. | |
| 2007/0084088 | A1* | 4/2007 | Shepherd | 37/231 |
| 2007/0101620 | A1 | 5/2007 | Roy | |
| 2007/0214683 | A1* | 9/2007 | Almadani | 37/234 |
| 2008/0222925 | A1* | 9/2008 | Belzile et al. | 37/231 |
| 2009/0105911 | A1* | 4/2009 | Okeson et al. | 701/49 |
| 2010/0034664 | A1* | 2/2010 | Wiegel et al. | 417/14 |
| 2010/0101119 | A1 | 4/2010 | Roberts | |
| 2011/0168417 | A1* | 7/2011 | Benesch | 172/829 |
| 2011/0277357 | A1* | 11/2011 | Schmeichel | 37/231 |

* cited by examiner

SLACK ROPE AND LIFT CONTROL FOR USE WITH PLOW

FIELD

The present disclosure relates generally to controlling raising and lowering of a working implement for a vehicle, and more particularly to controlling raising and lowering of a winch operated plow for an all-terrain vehicle.

BACKGROUND

This section provides background information related to the present disclosure which is not necessarily prior art.

All terrain vehicles and utility-terrain vehicles (ATVs and UTVs) are generally of a small size and weight and can be configured to carry one or more passengers. Such ATVs and UTVs can be provided with hitches for towing, plows for plowing snow and dirt, and winches that, among other things, can be used for getting the vehicle unstuck and/or raising and lowering the plow. In a conventional winch operated plow system, the winch can be driven in one direction to deploy cable and lower the plow, and in an opposite direction to reel cable and raise the plow. During such a lowering operation, it is possible to have the cable continue to deploy from the winch after the plow is resting on the ground, which can create undesirable slack in the cable. In addition, such conventional systems often rely on a user to stop the raising operation of the plow in order to prevent the plow or associated plow frame from undesirably contacting the vehicle.

SUMMARY

This section provides a general summary of the disclosure, and is not a comprehensive disclosure of its full scope or all of its features.

In one form, a system for controlling slack in a winch rope associated with a vehicle is provided. The system can include a winch, a working implement, at least one support member, a limit switch, a first member and a biasing member. The winch and the working implement can each be coupled to the vehicle and the working implement can be operatively associated with the winch. The support member can be pivotably coupled to a frame of the working implement and can carry a pulley that can be rotatably coupled thereto. The pulley can receive the winch rope for raising and lowering the working implement. The limit switch can be operatively associated with the frame and the winch and can be configured to selectively enable and disable lowering of the working implement by the winch. The first member can be carried by the at least one support member and can be operatively associated with the switch. The biasing member can be configured to bias the support member to a first position when a load on the winch rope is below a predetermined threshold. The first member can be in at least substantial alignment with the switch when the support member is in the first position. The switch can be configured to change an activation state upon the support member and the first member being in the first position to automatically disable lowering of the working implement by the winch.

In another form, a system for controlling raising of a device associated with a vehicle is provided. The system can include a winch, a working implement, a first member and a limit switch. The winch and the working implement can each be coupled to the vehicle and the working implement can be operatively associated with the winch. The first member can be coupled to one of a frame of the working implement and the vehicle, and the limit switch can be coupled to the other of the frame of the working implement and the vehicle. Upon raising the working implement relative to the vehicle to a predetermined raised position with the winch, the first member can be brought into at least substantial alignment with the limit switch to change an activation state of the limit switch and thereby disable raising of the working implement by the winch while allowing a lowering operation of the working implement by the winch.

In yet another form, a system for controlling raising and lowering of a device coupled to an all-terrain vehicle is provided. The system can include a winch coupled to the all-terrain vehicle and a plow coupled to the all-terrain vehicle and operatively associated with the winch. At least one support member can be pivotably coupled to a frame of the plow, where the support member can carry a pulley that can be rotatably coupled thereto and receive a winch rope of the winch for selectively raising and lowering the plow. A first Hall-effect switch can be operatively associated with the frame and the winch and can be configured to selectively enable and disable lowering of the working implement by the winch. A first magnet can be carried by the at least one support member and can be operatively associated with the first switch. A biasing member can be configured to bias the at least one support member to a first position when a load on the winch rope is below a predetermined threshold. The first member can be in at least substantial alignment with the switch when the at least one support member is in the first position. The switch can be configured to change an activation state upon the at least one support member and the first member being in the first position to automatically disable lowering of the plow by the winch, and to enable lowering of the plow when the load in the winch rope is greater than the predetermined threshold so as to overcome a biasing force of the biasing member and pivot the at least one support member from the first position to a second position where the first magnet is spaced apart from the first switch. A second magnet carried by the frame of the plow and a second Hall-effect switch can be coupled to the all-terrain vehicle and operatively associated with the winch. The second switch can be configured to change an activation state when the plow is raised to a predetermined raised position whereby the second magnet is at least substantially aligned with the second switch so as to be sensed by the second switch and thereby disable raising of the plow by the winch, and to change the activation state to enable raising of the plow by the winch when the second magnet is spaced apart from the second switch.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description, the appended claims and the following drawings. The drawings are for illustrative purposes only and are not intended to limit the scope of the present disclosure.

DETAILED DESCRIPTION

Figure 1:
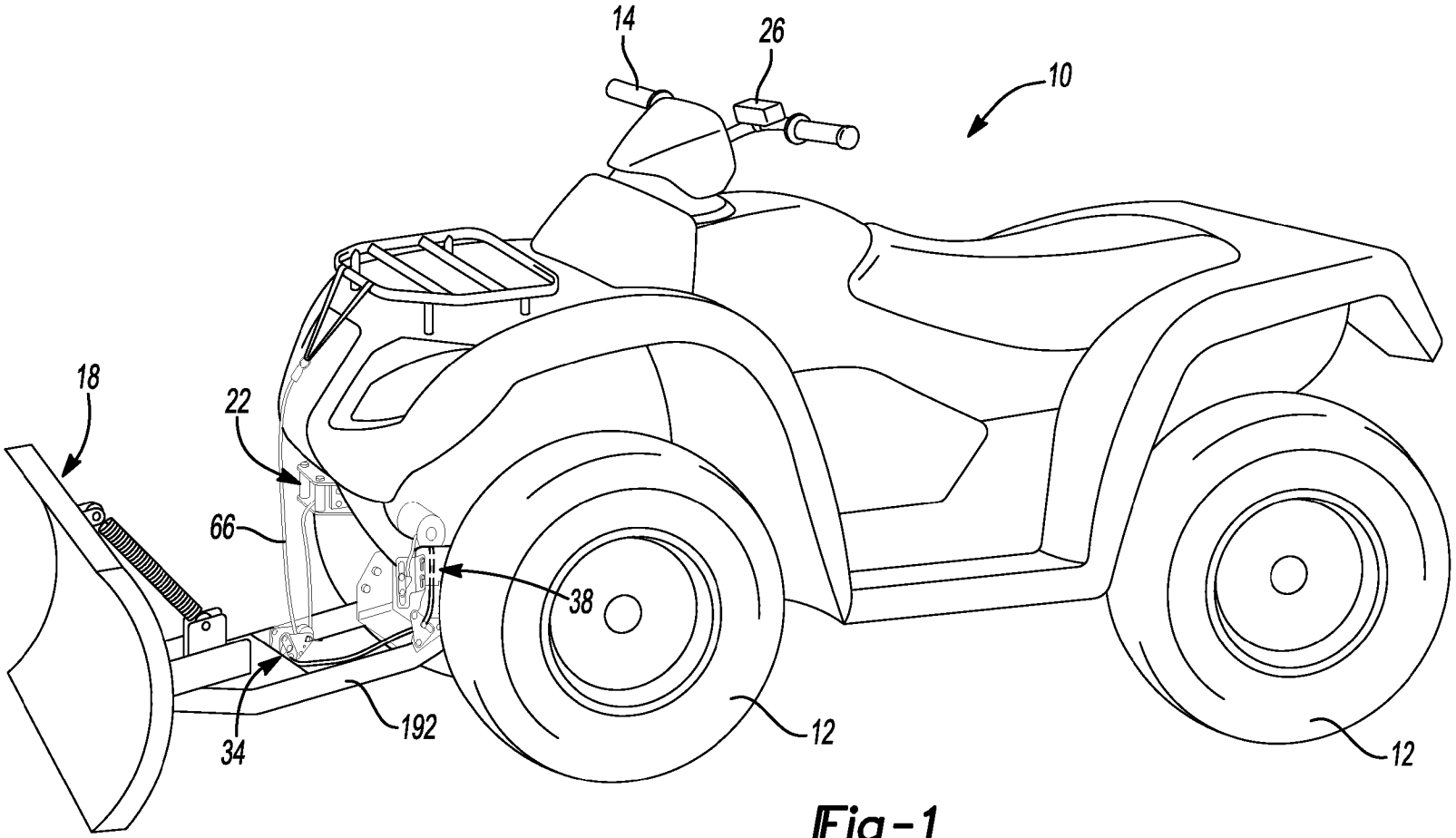
FIG. 1 is a perspective view of an exemplary winch operated plow system operatively associated with an exemplary all-terrain vehicle in accordance with the teachings of the present disclosure.

The following description is merely exemplary in nature and is not intended to limit the present disclosure, its application, or uses. It should be understood that throughout the drawings, corresponding reference numerals indicate like or corresponding parts and features. Exemplary embodiments are provided so that this disclosure will be thorough, and will fully convey the scope to those who are skilled in the art. Numerous specific details are set forth such as examples of specific components, devices, systems and/or methods, to provide a thorough understanding of exemplary embodiments of the present disclosure. It will be apparent to those skilled in the art that specific details need not be employed, that exemplary embodiments may be embodied in many different forms and that neither should be construed to limit the scope of the disclosure. In some exemplary embodiments, well-known processes, well-known device structures, and well-known technologies are not described in detail.

Although the following description is related generally to lift and slack rope control systems for a plow that is operatively associated with an all-terrain vehicle or utility-terrain vehicle (ATV or UTV), it should be appreciated that the slack rope control and lift control systems discussed herein can be applicable to other vehicles and/or systems including, but not limited to, farming or other agricultural vehicles.

Figure 2:
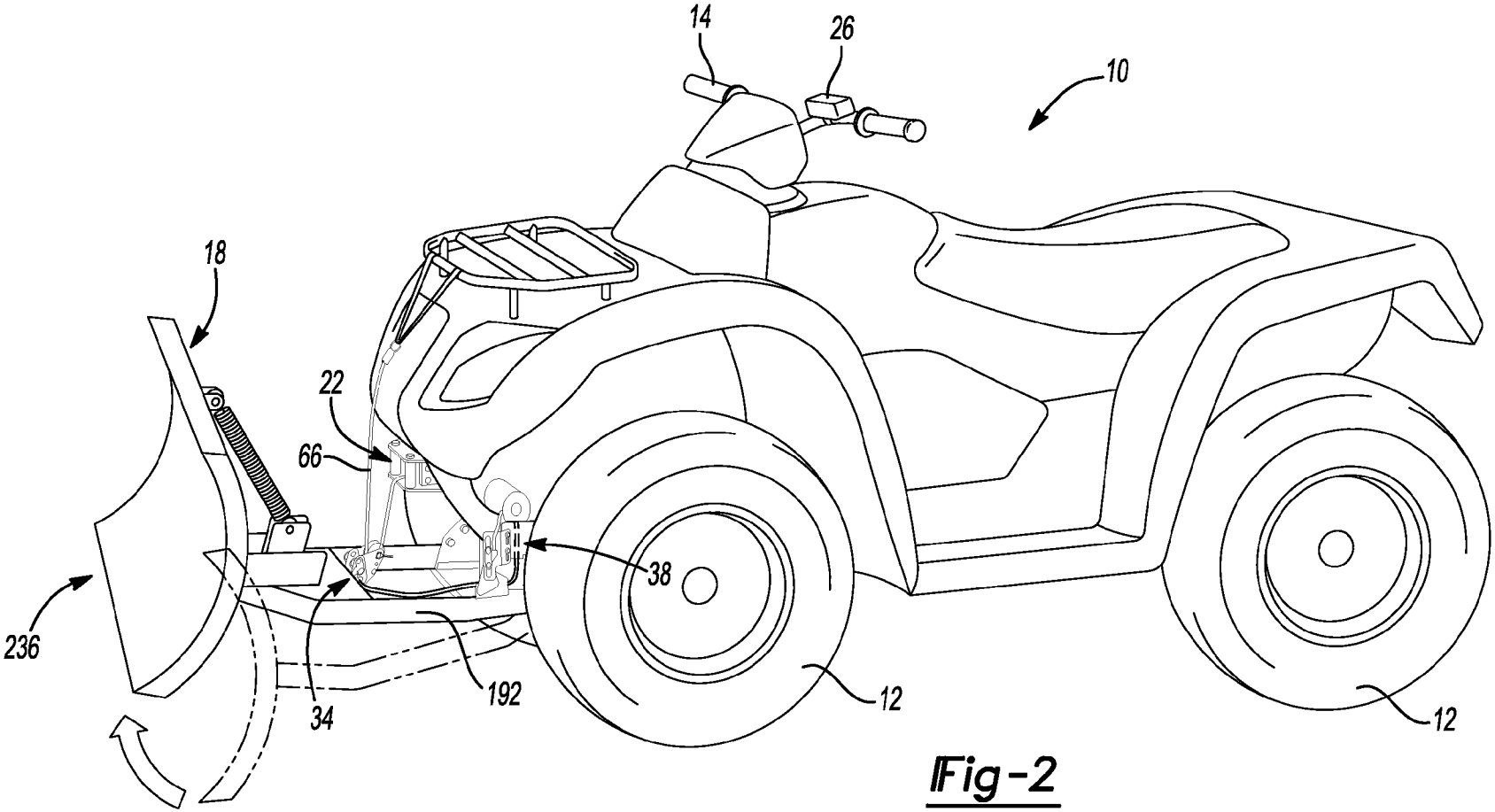
FIG. 2 is a perspective view of the winch operated plow system of FIG. 1 illustrating the plow in a raised position in accordance with the teachings of the present disclosure.

With initial reference to FIGS. 1 and 2, an exemplary all-terrain or utility terrain vehicle 10 is provided in accordance with the present teachings. The ATV 10, as shown, includes four wheels 12, although it should be understood that more or fewer wheels 12 can be provided. The ATV 10 can include a handlebar 14, a working implement such as plow assembly 18, a winch 22 operatively associated with the plow assembly 18, and a winch control interface 26 operatively associated with winch 22. In an exemplary configuration, winch control interface 26 can be positioned on handlebar 14, as shown in FIG. 1. As will be discussed in greater detail below, ATV 10 can also include a slack rope control system 34 and a lift control system 38 each operatively associated with plow assembly 18 and winch 22. It should be understood that ATV 10 can include one or both of the slack rope control system 34 and the lift control system 38. It should also be understood that while the following discussion will generally reference the illustrated plow assembly 18 as the working implement, alternative working implements could be utilized, such as a plow bucket.

With additional reference to FIGS. 3-6, the slack rope control system 34 will now be discussed in greater detail. Slack rope control system 34 can serve to prevent lowering of plow assembly 18 beyond a point or position that creates excess slack in a winch rope associated with winch 22, as will be discussed below. In one exemplary configuration, slack rope control system 34 can be mounted to a pair of spaced apart support brackets 42A, 42B fixed to a rear side of a frame 46 of plow assembly 18 by any suitable attachment method, such as by welding or fasteners. A pair of support plates 50A, 50B can be pivotably mounted to the support brackets 42A, 42B with a pivot fastener or bolt 54, as shown for example in FIGS. 3 and 4. Support plates 50A, 50B can pivotably rotate about pivot bolt 54 relative to support brackets 42A, 42B, as will be discussed below.

Figure 3:
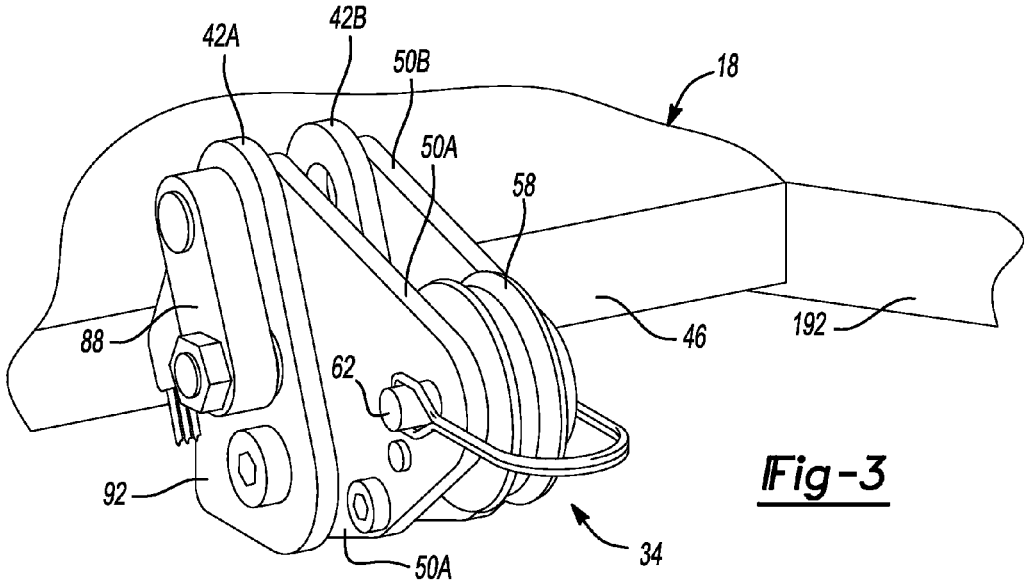
FIG. 3 is a perspective view of an exemplary slack rope control system in accordance with the teachings of the present disclosure.
Figure 4:
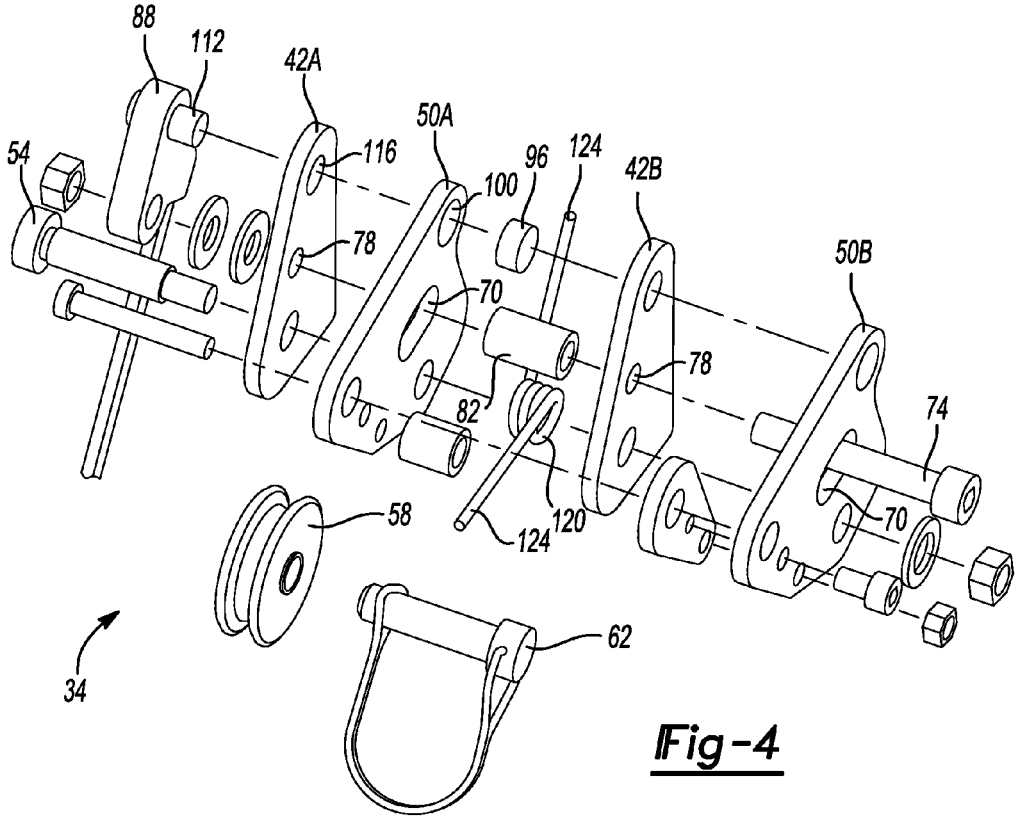
FIG. 4 is an exploded view of the slack rope control system of FIG. 3 in accordance with the teachings of the present disclosure.
Figure 6:
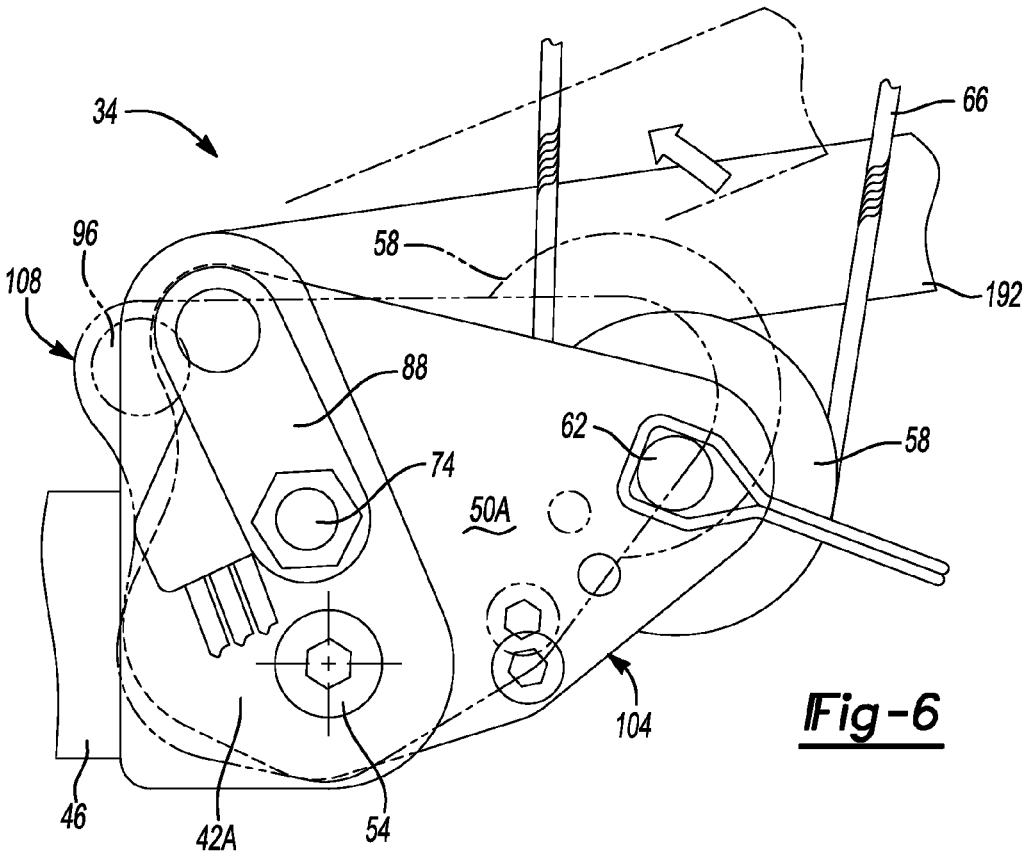
FIG. 6 is a side view of the slack rope control system illustrating an exemplary position of a sub-assembly of the system in both a loaded and unloaded position in accordance with the teachings of the present disclosure.

A pulley 58 can be received between support plates 50A, 50B and can be rotatably supported with a pin member, such as clevis fastener 62 shown in FIGS. 3 and 4. A winch rope 66, such as a braided steel cable, can be routed from winch 22 around pulley 58 and secured to ATV 10 in a suitable manner, as generally shown in FIG. 6 with reference to FIG. 1. Clevis fastener 62 can serve as an axle for pulley 58 and provide the ability to efficiently remove pulley 58 from support plates 50A, 50B to thereby disconnect winch rope 66 from plow assembly 18. Each support plate 50A, 50B can include an aperture or slot 70 sized and shaped to cooperate with a fastener 74. Fastener 74 can be received through apertures 78 in support brackets 42A, 42B and slot 70 in support plates 50A, 50B and can serve to limit the pivotable motion of plates 50A, 50B, as will be discussed in greater detail below. A compression limiter, such as spacer sleeve 82, can be used with fastener 74 and can cooperate with slot 70, as shown in FIG. 4.

A limit switch 88 can be coupled to one of the support plates 50A, 50B, as shown in FIGS. 3 and 4. In the exemplary configuration shown, limit switch 88 is coupled to an outer side 92 of bracket 42A and can be operatively associated with winch 22 and the winch control interface 26, as will be discussed in greater detail below. The limit switch 88 can be fastened to support plate 50A with fastener 74, as shown in FIG. 4, or with a separate fastener. In one exemplary configuration, limit switch 88 can include a Hall-effect switch configured to sense the presence of a magnetic field and open and close an associated circuit, as is know in the art. In this regard, a magnet 96 can be positioned in an aperture 100 of support plate 50A. Magnet 96 can be aligned with switch 88 when the support plates 50A, 50B are in an unloaded position 104 and misaligned with switch 88 when support plates are in a loaded position 108, as shown in FIG. 6 and will be discussed in greater detail below. While the system 34 will be described hereinafter with reference to Hall-effect switch 88, it should be appreciated that various proximity and physical contact limit switch arrangements can alternatively be utilized, if desired.

In one exemplary configuration Hall-effect switch 88 can further include an additional ferrite rod 112 protruding from the switch 88 and configured to align with magnet 96 in the unloaded position discussed above. Ferrite rod 112 can extend through an aperture 116 in support bracket 42A, as shown in FIG. 4, and can assist in directing or channeling the flux from magnet 96 into a sensor portion of the Hall-effect switch 88. Additionally, ferrite rod 112 can help to eliminate noise and improve detection time for the Hall-effect switch 88.

Figure 5:
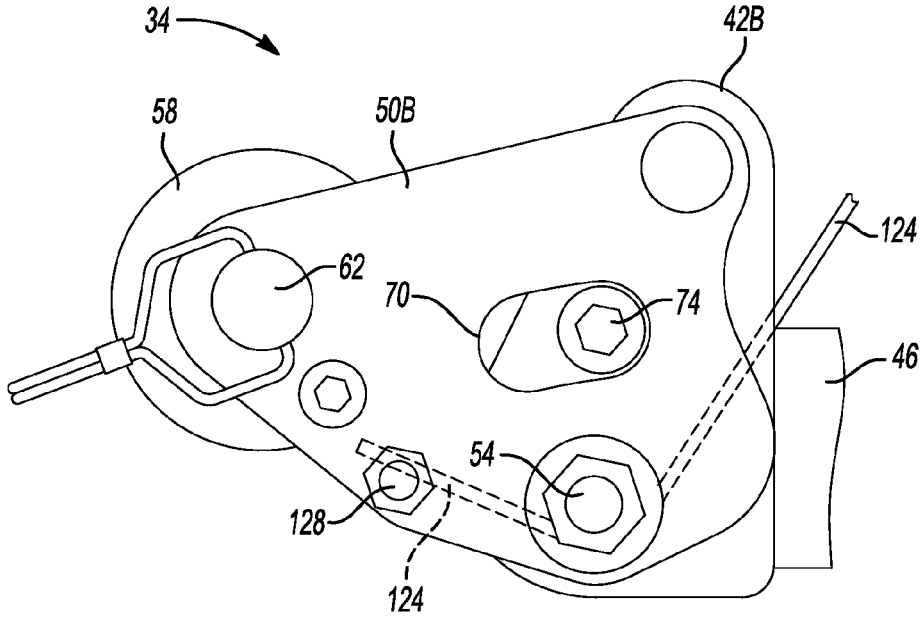
FIG. 5 is a side view of the slack rope control system in accordance with the teachings of the present disclosure.

Pivot bolt 54 can also support a biasing member, such as torsion spring 120, to bias support plates 50A, 50B, and thus magnet 96, to the unloaded position 104 shown, for example, in FIGS. 5 and 6. In one exemplary configuration, torsion spring 120 can include a pair of spring arms 124 engaging the plow frame 46 and a support fastener 128, respectively, to bias support plates 50A, 50B to the unloaded position 104.

While system 34 has been discussed above as having a pair of support brackets 42A, 42B and a corresponding pair of support plates 50A, 50B, it should be appreciated that system 34 could alternatively use a single support bracket and/or a single support plate, or variations thereof.

Figure 12:
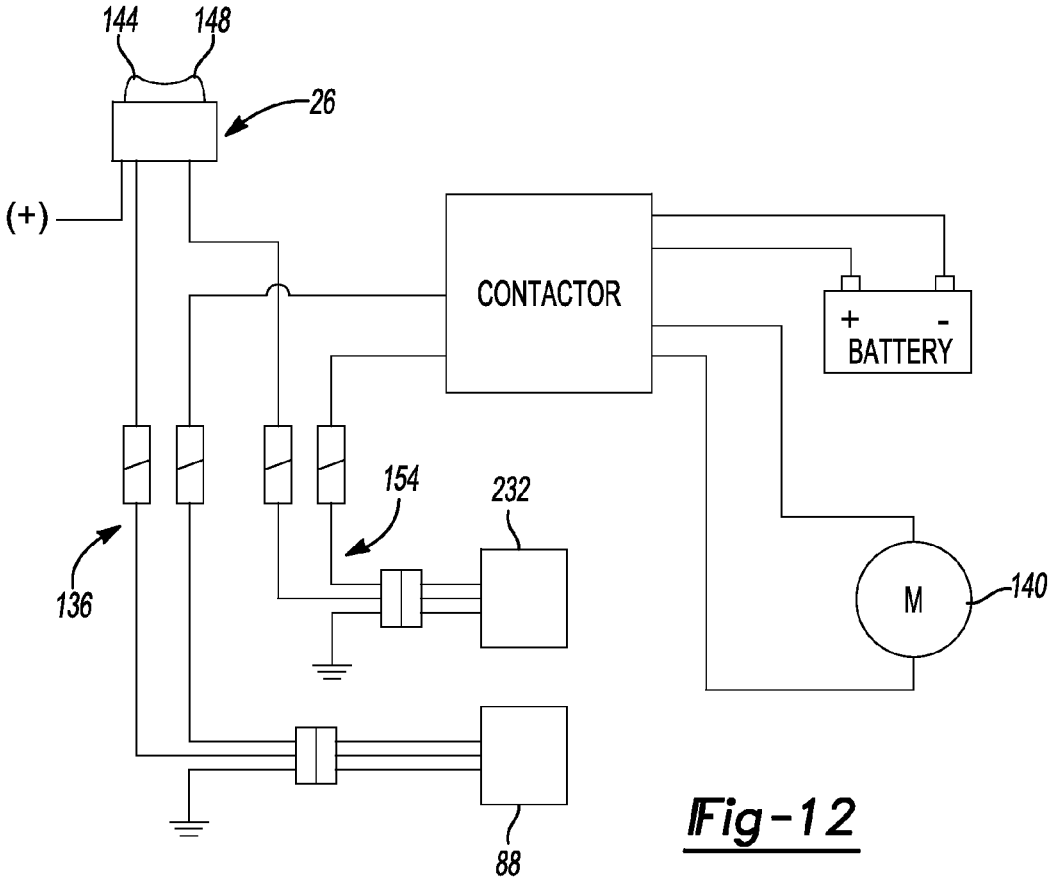
FIG. 12 is a schematic view of an exemplary circuit diagram for the slack rope and lift control systems in accordance with the teachings of the present disclosure.

With additional reference to FIG. 12, operation of the slack rope control system 34 will now be discussed. As can be appreciated by one of ordinary skill in the art, slack in winch rope 66 is undesirable and can lead to damage of the winch rope 66 and/or winch 22 in certain circumstances. In addition, slack in winch rope 66 when the plow assembly 18 is resting on the ground can increase response time to raise the plow from the lowered position. Slack rope control system 34 can be used to prevent deploying or spooling of winch rope 66 from winch 22 when the tension or load in winch rope 66 falls below a predetermined threshold, such as when plow assembly 18 is lowered to a point where it rests on a surface supporting ATV 10, as shown in FIG. 1.

In this regard, support plates 50A, 50B can pivot about pivot bolt 54 within a range of travel defined by slot 70 to place magnet 96 in or out of alignment with switch 88 depending on the tensile load provided by winch rope 66 on plates 50A, 50B through pulley 58. As discussed above, torsion spring can bias support plates 50A, 50B to the unloaded position 104 where magnet 96 is aligned with Hall-effect switch 88, as shown in FIG. 6. The biasing force of torsion spring 120 can be calibrated for specific applications and winch devices to ensure that support plates 50A, 50B are in or return to the unloaded position 104 when there is slack in the winch rope 66 or the tension falls below a predetermined threshold. When magnet 96 and Hall-effect switch 88 are aligned, switch 88 can sense magnet 96 and can be configured to change an activation state to automatically open a circuit 136 operatively associated with winch control interface 26 and winch 22 to deactivate winch motor 140. In this regard, Hall-effect switch 88 can override a plow lowering or winch-out user input switch 144 (FIG. 12) associated with winch control interface 26.

Winch control interface 26 can also include a plow raising or winch-in switch 148 (FIG. 12) engageable by a user to raise the plow by reeling in winch rope 66. The plow raising switch 148 can be on a separate circuit 154 than circuit 136 associated with plow lowering switch 144 such that deactivation of the plow-lowering switch 144 does not effect circuit 154 and thus the ability to initiate raising the plow via switch 148, as shown in FIG. 12. When sufficient tension is applied to winch rope 66 to overcome the bias of spring 120, such as by reeling in rope 66 via activation of switch 148, magnet 96 can rotate away from Hall-effect switch 88 and thus automatically re-enable the plow lowering function.

Figure 7:
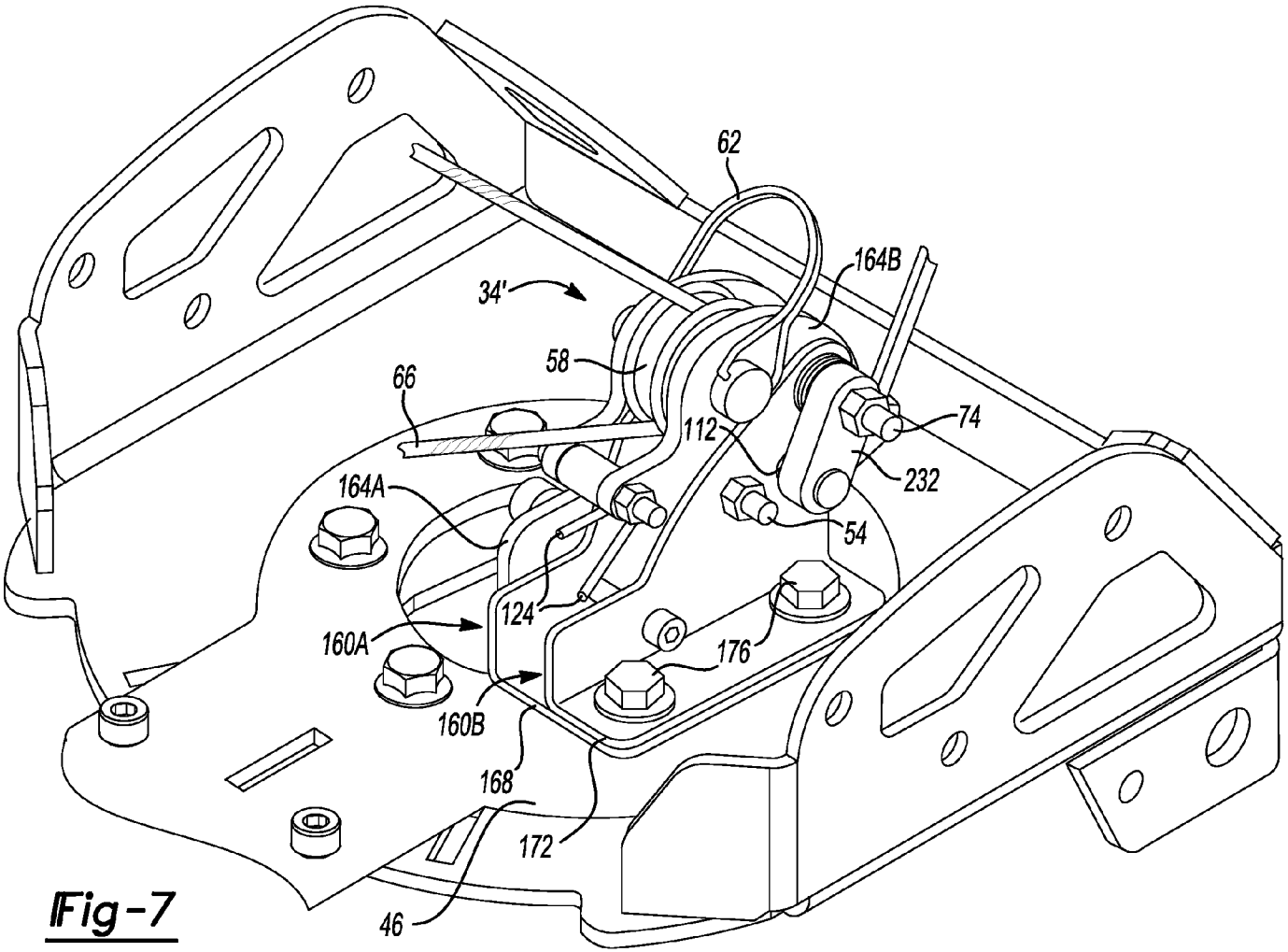
FIG. 7 is a perspective view of an exemplary alternative slack rope control system in accordance with the teachings of the present disclosure.
Figure 8:
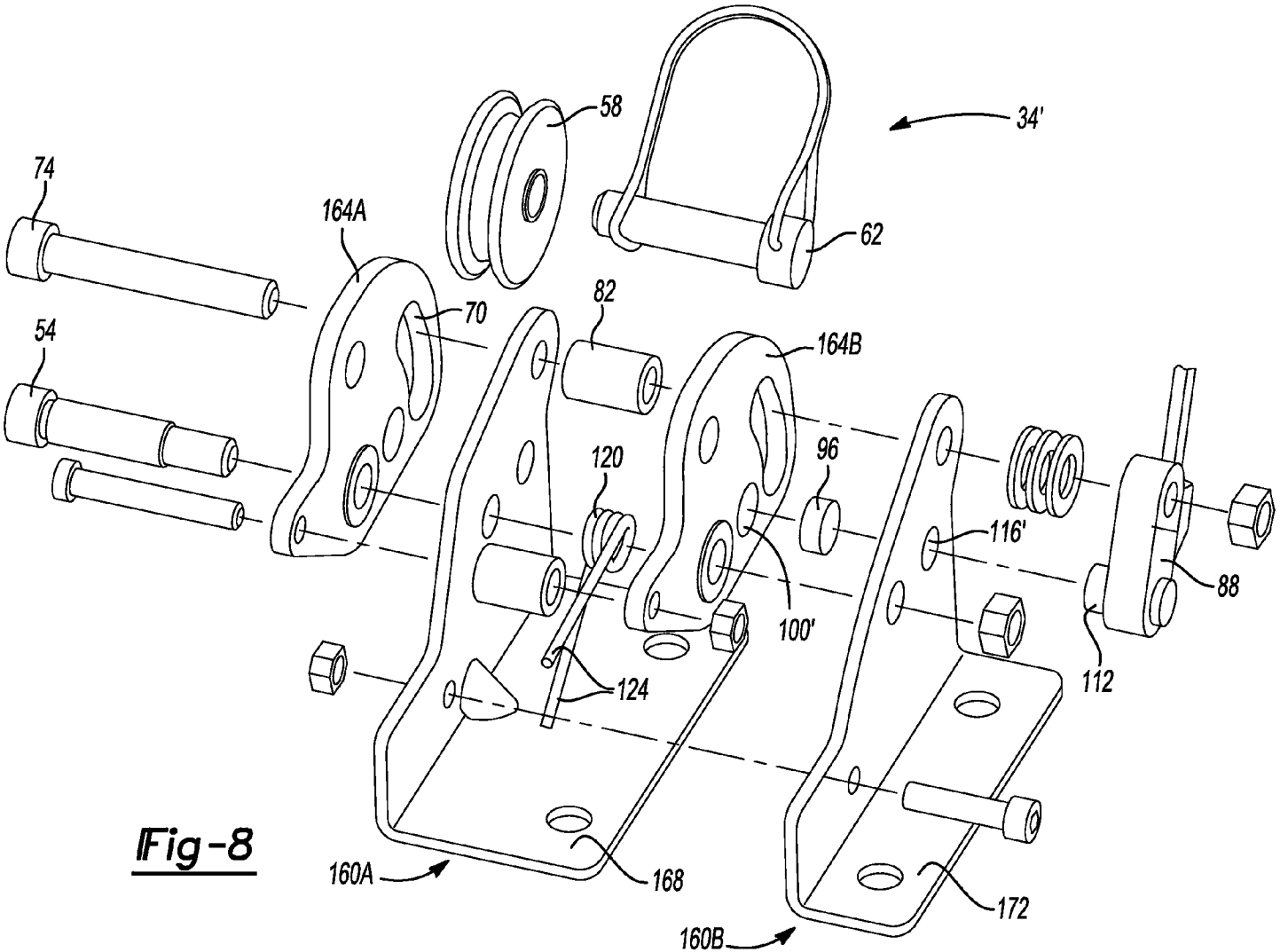
FIG. 8 is an exploded view of the alternative slack rope control system of FIG. 7 in accordance with the teachings of the present disclosure.

With additional reference to FIGS. 7 and 8, an exemplary alternative slack rope control system 34' will now be discussed, where like reference numerals have been used to identify elements similar to those previously introduced. System 34' is similar to system 34 such that only differences between systems 34' and 34 will now be discussed.

A pair of spaced apart brackets 160A, 160B each having an L-shaped configuration can be fastened or welded to an upper surface of plow frame 46. Brackets 160A, 160B and can support pivotable support plates 164A, 164B with pivot bolt 54 in a manner similar to system 34 discussed above. In one exemplary configuration, support bracket 160A can include a base 168 having a width sufficient to support base 172 of bracket 160B, as shown in FIG. 7. In this regard, base 172 of bracket 160B can be positioned on base 168 of bracket 160A in an assembled configuration such that only base 168 engages plow frame 46 when system 34' is assembled thereto. With this exemplary configuration, a pair of fasteners 176 can each extend through bases 168 and 172 to secure system 34' to plow frame 46, as also shown in FIG. 7.

At least one of support plates 164A, 164B can include slot 70 that cooperates with range limiting fastener 74, which can include optional spacer sleeve 82. Pulley 58 can be removably attached to support plates 164A, 164B with clevis fastener 62, as shown in FIGS. 7 and 8. In the exemplary system illustrated, Hall-effect switch 88 with ferrite rod 112 can be coupled to support bracket 160B with ferrite rod 112 extending through an aperture 116' in bracket 160B. Support plate 164B can carry magnet 96 in aperture 100' so as to be aligned or misaligned with Hall-effect switch 88 depending on the loading of winch rope 66, as discussed above. Pivot bolt 54 can carry torsion spring 120 to bias support plates 164A, 164B to the unloaded position where magnet 96 is aligned with Hall-effect switch 88. When sufficient tension is applied to rope 66 by winch 22, support plates 164A, 164B can rotate against the bias of spring 120 about pivot bolt 54 in a direction towards ATV 10. Such rotation can misalign magnet 96 from switch 88 to enable the plow-lowering feature in a similar manner as system 34 discussed above.

Figure 9:
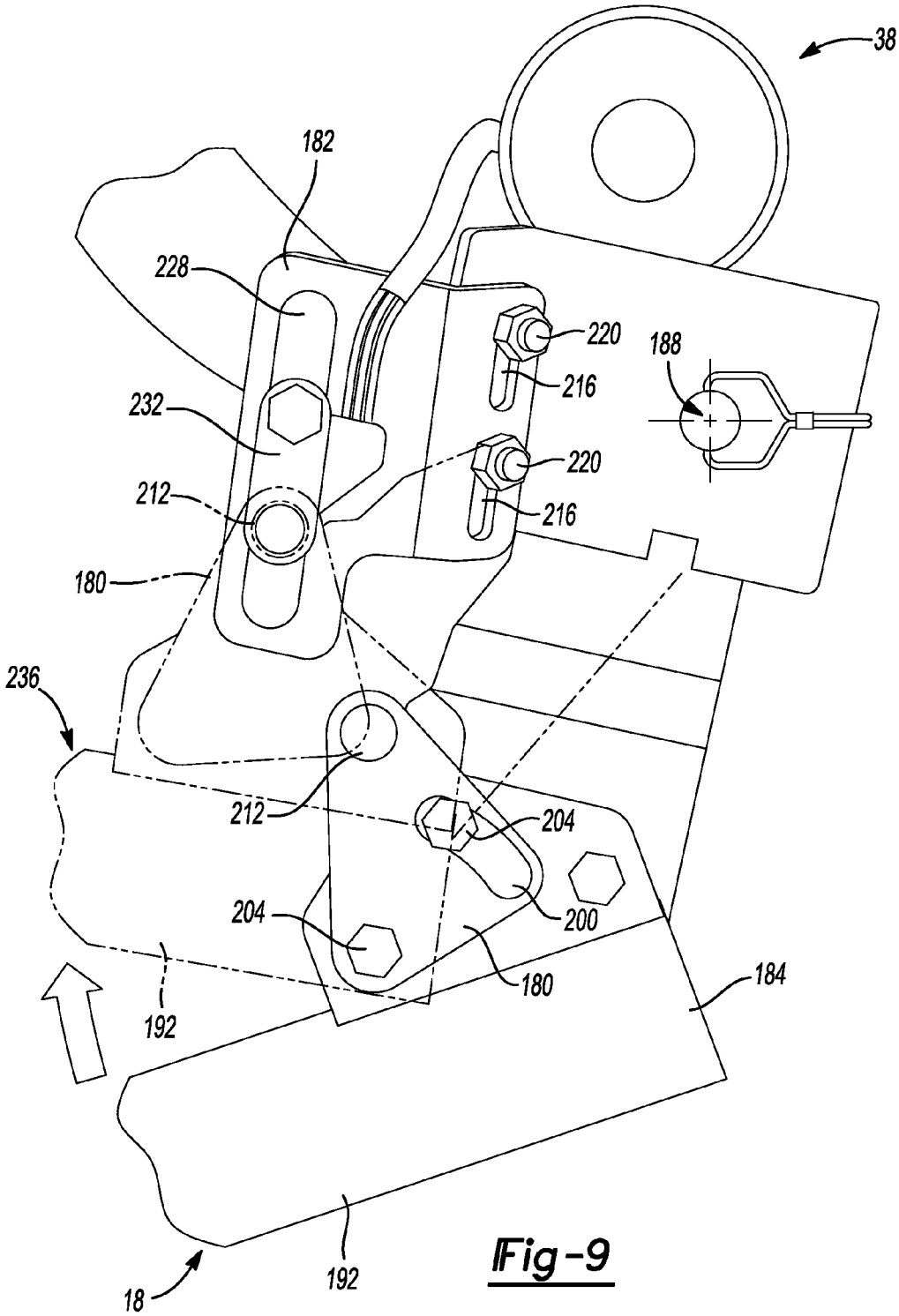
FIG. 9 is a side view of an exemplary lift control system in accordance with the teachings of the present disclosure.
Figure 10:
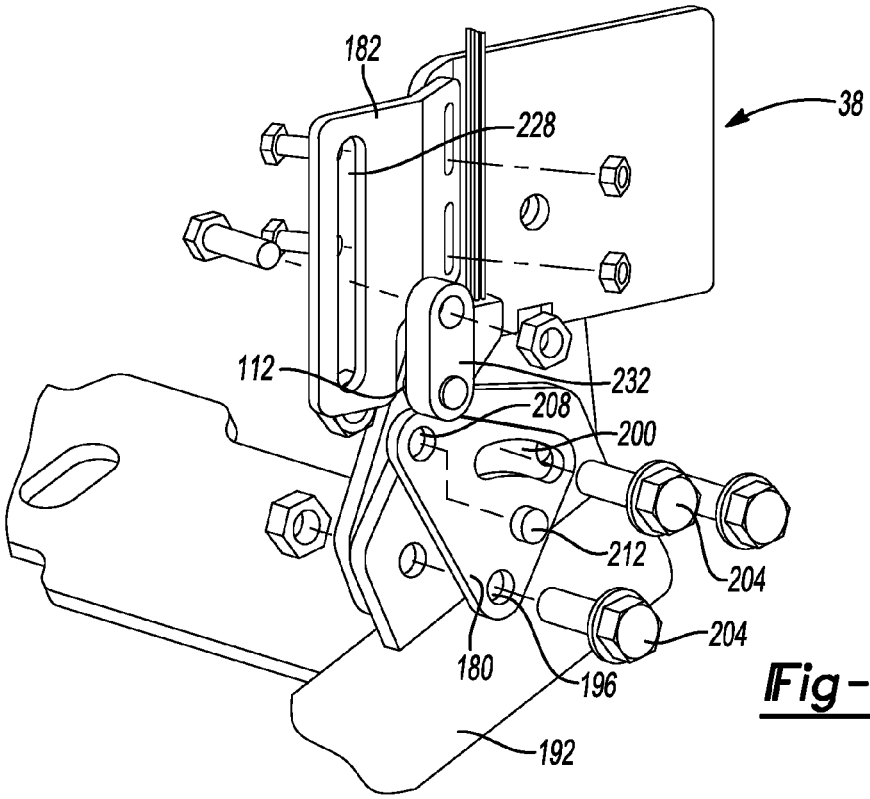
FIG. 10 is a partial exploded view of the exemplary lift control system of FIG. 9 in accordance with the teachings of the present disclosure.
Figure 11:
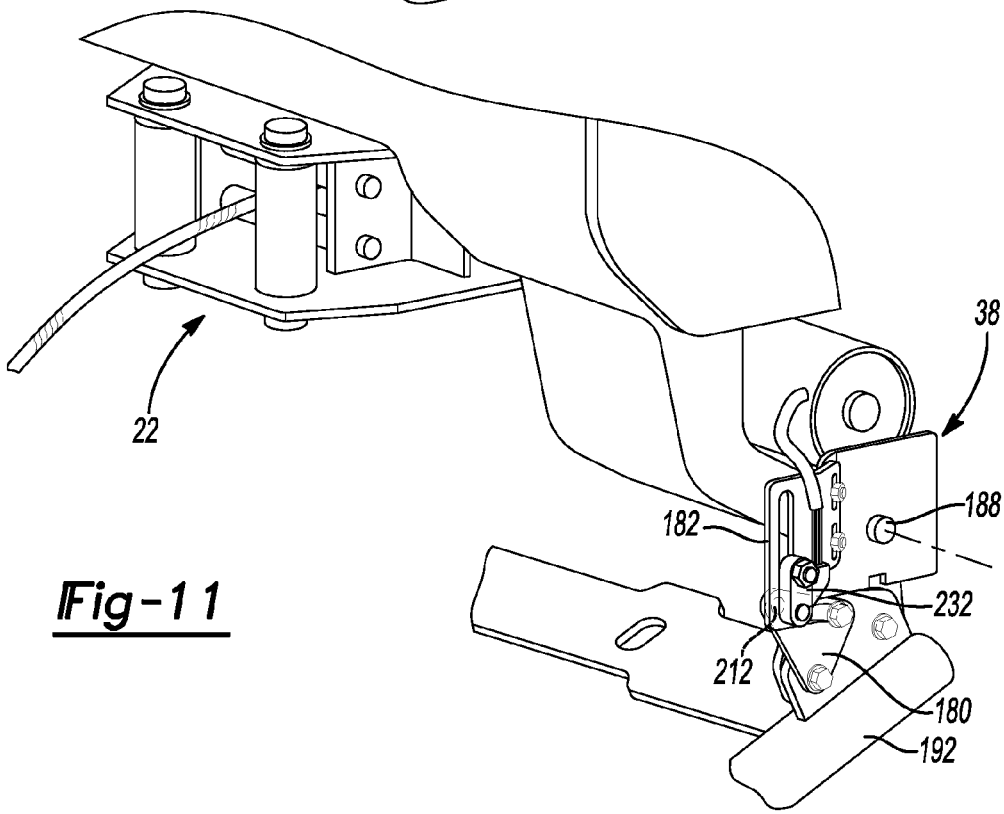
FIG. 11 is a perspective view of the lift control system with the plow in the raised position in accordance with the teachings of the present disclosure.

Turning now to FIGS. 9-12, the lift control system 38 will now be discussed in greater detail. The lift control system can be operatively associated with the plow assembly 18, winch motor 140 and winch control interface 26 to deactivate a plow lifting operation at a predetermined lifted or raised position of the plow assembly 18. In the exemplary configuration illustrated, lift control system 38 can include a first bracket or plate 180 coupled to plow assembly 18 and a second bracket or plate 182 coupled to ATV 10. In one exemplary configuration first plate 180 can be secured to frame portion 184 proximate a location 188 where plow assembly 18 is pivotably coupled to ATV 10, as shown in FIGS. 9 and 11 with reference to FIG. 2. In this exemplary configuration, first plate 180 can be secured to an arm 192 of plow assembly 18. First plate 180 can include an aperture 196 and a slot 200 each configured to receive a fastener 204 to secure first plate 180 to plow assembly 18. Slot 200 can provide an ability to pivotably adjust plate 180 relative to fastener 204 for alignment with second plate 182, as will be discussed below in greater detail. First plate 180 can include an additional aperture 208 configured for carrying a magnet 212 similar to magnet 96 discussed above.

Second plate 182 can be coupled to ATV 10 proximate location 188 so as to be in selective alignment with first plate 180. Second plate 182 can include a pair of apertures 216 for receiving fasteners 220 to secure plate 182 to ATV 10. In one exemplary configuration, apertures 216 can be a single elongate slot or separate elongate slots to provide for adjustment of a location of second plate 182 relative to ATV 10 and first plate 180. An additional elongated aperture or slot 228 can be provided in second plate 182 spaced apart from apertures 216 and can be configured to receive a Hall-effect switch 232 similar to Hall-effect switch 88 discussed above. Hall-effect switch 232 can also include the ferrite rod 112 discussed above. Slot 228 can provide for adjustable alignment of Hall-effect switch 232 relative to first plate 180 and can receive a distal portion of ferrite rod 112 therein.

First and second plates 180, 182 can be adjusted as discussed above so that magnet 212 will align with Hall-effect switch 232 when plow assembly 18 is raised to a predetermined lifted position, such as lifted position 236 shown in FIGS. 2 and 9. When Hall-effect switch 232 senses the flux from magnet 212, the sensor can be configured to change an activation state to automatically open circuit 154 (FIG. 12) so as to deactivate the plow raising switch 148 and winch motor 140. In this regard, the Hall-effect switch 232 can be adjusted relative to second plate 182 to set the desired maximum lifted position 236 of plow assembly 18 relative to ATV 10.

With continued reference to FIGS. 9-12, operation of the lift control system 38 will now be discussed in greater detail. Upon a user initiating a plow lifting or raising operation by activating plow raising switch 148, winch 22 can reel in winch rope 66 to raise plow assembly 18 as discussed above. As plow assembly 18 is being raised, magnet 212 carried by first plate 180 moves with plow arm 192 towards Hall-effect switch 232, as shown in FIGS. 2 and 9. When plow assembly 18 is raised to the predetermined desired lifted position 236, as set by the position of Hall-effect switch 232 relative to second plate 182, switch 232 senses magnet 212 and automatically opens circuit 154 thereby deactivating plow raising switch 148 and thus winch motor 140.

Upon magnet 212 being misaligned with Hall-effect switch 232 such that switch 232 no longer senses magnet 212, Hall-effect switch 232 can be configured to automatically close circuit 154 thereby enabling lifting of plow assembly 18 via plow raising switch 148. As discussed above, the plow raising switch 148 and the plow lowering switch 144 are on separate circuits such that deactivating the lifting operation of the plow via Hell-effect switch 232 does not affect an ability to lower the plow assembly via switch 144 and circuit 136. In this regard, upon the raising operation being deactivated as discussed above, the plow assembly 18 can thereafter be lowered upon which the plow raising feature will automatically be re-enabled.

The slack rope control and lift control systems 34 and 38 provide for efficiently controlling the raising and lowering of a winch operated plow so as to automatically eliminate excess slack in the winch rope as well as to automatically deactivate lifting of the plow beyond a predetermined maximum lift point. The systems 34 and 38 can thus serve to reduce, if not eliminate, damage to the winch and/or ATV by such excess lack and/or uncontrolled lifting of the plow. In addition, use of the non-contacting Hall-effect switches can serve to reduce any potential issues associated with dirt or debris that may be encountered with use of the ATV. Further, the brackets and/or plates of systems 34 and 38 provide for easy adaptability to various vehicles configurations and are easily adjustable to, for example, vary the desired lifted position of the plow.

While one or more specific examples have been described and illustrated, it will be understood by those skilled in the art that various changes may be made and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof.

What is claimed is:

1. A system for controlling slack in a winch rope associated with a vehicle, comprising:

a winch coupled to the vehicle;

a working implement coupled to the vehicle and operatively associated with the winch;

at least one support member pivotably coupled to a frame of the working implement, the at least one support member carrying a pulley rotatably coupled thereto, the pulley receiving the winch rope for raising and lowering the working implement;

a limit switch operatively associated with the frame and the winch and configured to selectively enable and disable lowering of the working implement by the winch;

a first member carried by the at least one support member and operatively associated with the switch; and a biasing member configured to bias the at least one support member to a first position when a load on the winch rope is below a predetermined threshold, the first member being in at least substantial alignment with the switch when the at least one support member is in the first position, the switch configured to change an activation state upon the at least one support member and the first member being in the first position to automatically disable lowering of the working implement by the winch.

2. The system of claim 1, wherein the switch is configured to enable lowering of the working implement when the load in the winch rope is greater than the predetermined threshold so as to overcome a biasing force of the biasing member and pivot the support member from the first position to a second position where the first member is spaced apart from the switch.

3. The system of claim 2, wherein the at least one support member includes an elongated aperture sized and shaped to move relative to a fixed fastener to limit pivotable motion of the at least one support member between the first and second positions.

4. The system of claim 2, further comprising an electrical circuit operatively associated with at least the switch and the winch, wherein the switch in cooperation with the circuit are configured to disable lowering of the working implement by the winch when the at least one support member is in the first position while allowing raising of the working implement by the winch.

5. The system of claim 1, wherein the working implement includes a plow.

6. The system of claim 1, wherein the switch includes a Hall-effect switch and the first member includes a magnet.

7. The system of claim 6, wherein the Hall-effect switch includes a ferrite member protruding therefrom in a direction towards the at least one support member, the ferrite member configured to direct flux from the magnet into a sensor portion of the Hall-effect switch.

8. The system of claim 1, further comprising a pivot member secured to the frame and extending through an aperture in the at least one support member whereby the at least one support member pivots about the pivot member.

9. The system of claim 8, wherein the pivot member carries the biasing member.

10. The system of claim 1, wherein the vehicle includes an all-terrain vehicle.

11. The system of claim 1, further comprising at least one support bracket fixed to the frame, wherein the at least one support member is pivotably coupled to the at least one support bracket.

12. The system of claim 1, wherein the at least one support member includes a pair of support members spaced apart from each other and removably receiving the pulley therebetween.

13. The system of claim 12, further comprising a pair of support brackets fixed to the frame, wherein the pair of support members are coupled to each other and each support member is positioned adjacent one of the support brackets of the pair of support brackets, the pair of support members being pivotably coupled to the pair of support brackets.

14. The system of claim 13, wherein the switch includes a Hall-effect switch coupled to one of the support brackets, and the first member includes a magnet carried by an adjacent one of the support members, the Hall-effect switch including a ferrite member protruding therefrom toward the magnet and extending through an aperture in the one of the support brackets.

15. The system of claim 1, wherein the switch includes a limit switch configured to be contacted by the first member when the at least one support member is in the first position.

16. A system for controlling raising of a device associated with a vehicle, comprising:

a winch coupled to the vehicle;

a plow pivotably coupled to the vehicle and operatively associated with the winch;

a first member coupled to one of a frame of the plow and the vehicle; and a limit switch coupled to the other of the frame of the plow and the vehicle;

wherein upon raising the plow relative to the vehicle to a predetermined raised position with the winch, the first member is brought into at least substantial alignment with the limit switch to change an activation state of the limit switch and thereby disable raising of the plow by the winch while allowing a lowering operation of the plow by the winch.

17. The system of claim 16, wherein, and wherein the vehicle includes an all-terrain vehicle.

18. The system of claim 16, wherein the first member is coupled to the frame of the plow and the limit switch is coupled to the vehicle.

19. The system of claim 18, further comprising a first support plate coupled to the frame and carrying the first member, the plow being pivotably moveable relative to the vehicle such that in a lowered position the first member is spaced apart from the limit switch and in the raised position the first member is in at least substantial alignment with the limit switch.

20. The system of claim 19, wherein the system further comprises a circuit operatively associated with at least the limit switch and the winch, the switch in cooperation with the circuit being configured to disable a reeling operation of rope from the winch when the first member is in at least substantial alignment with the switch while allowing a deploying operation of the rope from the winch.

21. The system of claim 19, further comprising a second support member coupled to the vehicle, the limit switch being adjustably coupled to the second support member.

22. The system of claim 21 wherein the limit switch includes a Hall-effect switch and the first member includes a magnet.

23. The system of claim 22, wherein the Hall-effect switch includes a ferrite member protruding therefrom in a direction toward the magnet and extending through an aperture in the second support member, the ferrite member configured to direct flux from the magnetic into a sensor portion of the Hall-effect switch.

24. The system of claim 16, wherein the limit switch is configured to automatically re-enable raising of the plow by the winch when the first member is spaced apart from the limit switch.

25. The system of claim 16, wherein the limit switch is configured to be contacted by the first member to activate the limit switch and disable raising of the plow by the winch.

26. The system of claim 16, wherein the limit switch is coupled to the frame of the plow and the first member is coupled to the vehicle.

27. A system for controlling raising and lowering of a device coupled to an all-terrain vehicle, comprising:

a winch coupled to the all-terrain vehicle;

a plow coupled to the all-terrain vehicle and operatively associated with the winch;

at least one support member pivotably coupled to a frame of the plow, the support member carrying a pulley rotatably coupled thereto, the pulley receiving a winch rope of the winch for selectively raising and lowering the plow;

a first Hall-effect switch operatively associated with the frame and the winch and configured to selectively enable and disable lowering of the working implement by the winch;

a first magnet carried by the at least one support member and operatively associated with the first switch;

a biasing member configured to bias the at least one support member to a first position when a load on the winch rope is below a predetermined threshold, the first member being in at least substantial alignment with the switch when the at least one support member is in the first position, the switch configured to change an activation state upon the at least one support member and the first member being in the first position to automatically disable lowering of the plow by the winch, and to enable lowering of the plow when the load in the winch rope is greater than the predetermined threshold so as to overcome a biasing force of the biasing member and pivot the at least one support member from the first position to a second position where the first magnet is spaced apart from the first switch;

a second magnet carried by the frame of the plow; and a second Hall-effect switch coupled to the all-terrain vehicle and operatively associated with the winch, the second switch configured to change an activation state when the plow is raised to a predetermined raised position whereby the second magnet is at least substantially aligned with the second switch so as to be sensed by the second switch and thereby disable raising of the plow by the winch and to change the activation state to enable raising of the plow by the winch when the second magnet is spaced apart from the second switch.

28. The system of claim 27, further comprising a pivot member pivotably coupling the at least one support member to the frame, the pivot member carrying the biasing member.

29. The system of claim 27, wherein the first and second Hall-effect switches each include a ferrite rod protruding therefrom in a direction toward the respective first and second magnets, the ferrite rods configured to channel flux from the respective magnets into sensor portions of the respective first and second Hall-effect switches.

30. A system for controlling slack in a winch rope associated with a plow coupled to a vehicle, comprising:

means for raising and lowering the plow;

means for pivotably coupling at least one support member to the plow, the support member rotatably receiving winch rope for selectively raising and lowering the plow;

means for biasing the at least one support member to a first position when a load in the winch rope is below a predetermined threshold, wherein when the load in the winch rope is above the predetermined threshold the at least one support member is pivoted to a second position spaced apart from the first position;

means for sensing when the at least one support member is in the first position and the second position; and means for disabling a deploying operation of the winch to lower the plow when the means for sensing senses the at least one support member is in the first position while allowing a reeling operation of the winch to raise the plow, and for automatically enabling the deploying operation of the winch to lower the plow when the means for sensing sense that the at least one support member is spaced apart from the first position.

* * * * *